US007004068B2

(12) United States Patent
Sappal

(10) Patent No.: US 7,004,068 B2
(45) Date of Patent: Feb. 28, 2006

(54) FOLDER AND FOLDING CYLINDER

(75) Inventor: Jatinder Singh Sappal, Epping, NH (US)

(73) Assignee: Goss International Americas, Inc., Dover, NH (US)

( * ) Notice: Subject to any disclaimer, the term of this patent is extended or adjusted under 35 U.S.C. 154(b) by 201 days.

(21) Appl. No.: 10/637,795

(22) Filed: Aug. 8, 2003

(65) Prior Publication Data

US 2005/0029729 A1 Feb. 10, 2005

(51) Int. Cl.
*B41F 5/04* (2006.01)

(52) U.S. Cl. ..... 101/216; 101/219

(58) Field of Classification Search ..... 270/5.01, 270/6, 8, 5.02, 41, 42, 45, 47; 101/216, 219, 101/220; 493/424, 428, 429
See application file for complete search history.

(56) References Cited

U.S. PATENT DOCUMENTS 4,790,804 A * 12/1988 Gotou et al. ..... 493/226
6,367,792 B1 * 4/2002 Chagnon ..... 270/5.02
6,843,763 B1 * 1/2005 Jackson et al. ..... 493/428
2002/0046665 A1 * 4/2002 Maresse et al. ..... 101/226
2002/0132716 A1 9/2002 Herda et al. ..... 493/405
2002/0185022 A1 * 12/2002 Stieler et al. ..... 101/216

FOREIGN PATENT DOCUMENTS

EP 1371592 12/2003

* cited by examiner

*Primary Examiner*—Anthony H. Nguyen
(74) *Attorney, Agent, or Firm*—Davidson, Davidson & Kappel, LLC

(57) ABSTRACT

A folder cylinder with an outer circumferential surface has a first section having a first part at the outer circumferential surface of the cylinder and a second section having a second part at the outer circumferential surface of the cylinder, the first section being movable with respect to the second section, the first part being spaced from the second part at the outer circumferential surface in a first operating mode by a gap. A circumferential surface part is attached movably to the second section and defining at the gap part of the outer circumferential surface during the first operating mode. The circumferential surface part is freely rotatable in a radially inward direction with respect to the second section when the circumferential surface part is located at the outer circumferential surface. The circumferential surface part also has a radially extending inclined surface facing the outer circumferential surface for interacting with the first section so as to retract the circumferential surface part beneath the first part.

13 Claims, 4 Drawing Sheets

FOLDER AND FOLDING CYLINDER

BACKGROUND INFORMATION

The present invention relates generally to folders for printed products, and more particularly to folders having rotating cylinders.

U.S. Pat. No. 6,367,792, hereby incorporated by reference herein, discloses a jaw folder having a copy-guiding cylinder, a jaw cylinder, and a cross-folding cylinder. The folder has a double parallel-fold folding mode and a delta fold folding mode. The copy-guiding cylinder has circumferential surface parts assigned to the grippers and to the folding blades of the copy-guiding cylinder. In the delta folding mode, the circumferential surface parts assigned to the grippers are extended to form part of the cylinder surface, while the circumferential surface parts assigned to the folding blades are retracted therein. A guide element mounted on a movable segment of the cylinder moves the circumferential surface parts between the extended and the retracted positions via a follower element attached to the circumferential surface part. A spacing remains at the surface when the circumferential surface part is retracted.

U.S. Pat. No. 5,429,578, also incorporated by reference herein, discloses a folding machine with a transfer cylinder having a half-cut position and a one-third cut position. Sliding circumferential surface parts, called closure plates, reduce the circumferential opening in the one-third cut position.

BRIEF SUMMARY OF THE INVENTION

An object of the present invention is to reduce the complexity of movable circumferential surface parts.

A further alternate or additional object of the invention is to reduce the cost of such parts.

Yet another alternate or additional object of the present invention is to provide for improved operation of circumferential surface parts.

The present invention provides a folder cylinder with an outer circumferential surface comprising:

a first section having a first part at the outer circumferential surface of the cylinder;

a second section having a second part at the outer circumferential surface of the cylinder, the first section being movable with respect to the second section, the first part being spaced from the second part at the outer circumferential surface in a first operating mode by a gap; and a circumferential surface part attached movably to the second section and defining at the gap part of the outer circumferential surface during the first operating mode, the circumferential surface part being freely rotatable in a radially inward direction with respect to the second section when the circumferential surface part is located at the outer circumferential surface.

By having the circumference surface part be freely rotatable in a radially inward direction, guide elements which proscribe the motion of the circumferential surface part advantageously can be eliminated and provide for a simpler retraction device provided.

The cylinder may include a stop on the second section for blocking rotation of the circumferential surface part in a direction opposite the radially inward direction.

The cylinder preferably includes a spring for forcing the circumferential surface part opposite the radially inward direction.

The first part preferably contacts the circumferential surface part during a second operating mode so as to force the circumferential surface part in the radially inward direction.

The folder cylinder may include a first jaw attached to the first section and a second jaw attached to the second section, although the invention is applicable to other folder cylinders, for example tucking cylinders.

The present invention also provides a folder cylinder with an outer circumferential surface comprising:

a first section having a first part at the outer circumferential surface of the cylinder;

a second section having a second part at the outer circumferential surface of the cylinder, the first section being movable with respect to the second section, the first part being spaced from the second part at the outer circumferential surface in a first operating mode by a gap; and a circumferential surface part attached movably to the second section and forming part of the outer circumferential surface at the gap during the first operating mode, the circumferential surface part having a radially-extending inclined surface facing the outer circumferential surface for interacting with the first section so as to retract the circumferential surface part beneath the first part.

The inclined surface of the circumferential surface part provides a simple and effective method for retracting the circumferential surface part, as a force on the inclined surface causes the circumferential surface part to retract.

The inclined surface preferably has the same axial extent as the first section.

The present invention also provides a method for changing modes in a cylinder in a folder comprising the steps of:

moving a first section of the cylinder with respect to a second section so as to narrow a gap between the first section and second section, the first section having a first part at the outer circumferential surface of the cylinder and the second section having a second part at the outer circumferential surface of the cylinder; and contacting a circumferential surface part attached movably to the second section with the first section so as to force the circumferential surface part inwardly, the circumferential surface part being freely rotatable in a radially inward direction with respect to the second section when the contact occurs.

The present invention further provides a method for changing modes in a cylinder in a folder comprising the steps of:

moving a first section of the cylinder with respect to a second section so as to narrow a gap between the first section and second section, the first section having a first part at the outer circumferential surface of the cylinder and the second section having a second part at the outer circumferential surface of the cylinder; and contacting, with the first section, a radially-extending inclined surface of a circumferential surface part attached movably to the second section so as to force the circumferential surface part inwardly, the radially-extending inclined surface facing the outer circumferential surface.

BRIEF DESCRIPTION OF THE DRAWINGS

An exemplary embodiment of the present invention is described below by reference to the following drawings, in which.

DETAILED DESCRIPTION

Figure 1:
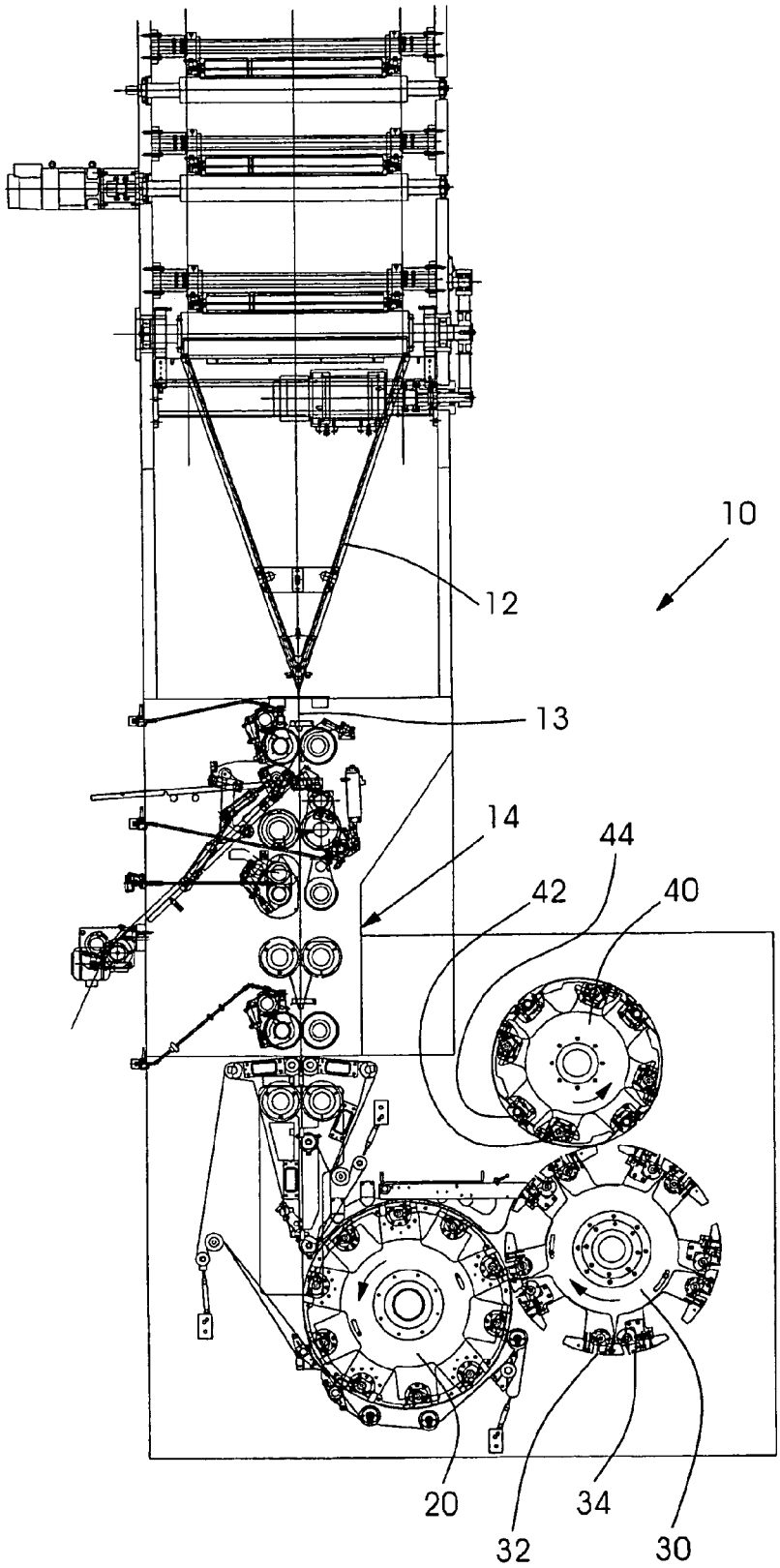
FIG. 1 shows a side view of a folder according to the present invention.

FIG. 1 shows partially a pinless folder 10 having a former board 12 for folding a web 13, and a cutting device 14 for cutting the web into copies, i.e. signatures. A first tucking cylinder 20 has alternating grippers and tuckers, the tuckers tucking the signatures into first jaws 32 of a jaw cylinder 30. The signatures may then be transferred for a double parallel fold to a second tucking cylinder 40, which has grippers 42 and tuckers 44. Tuckers 44 tuck the second fold into the second jaws 34 of jaw cylinder 30, which then can release the signatures for further transport.

Figure 2:
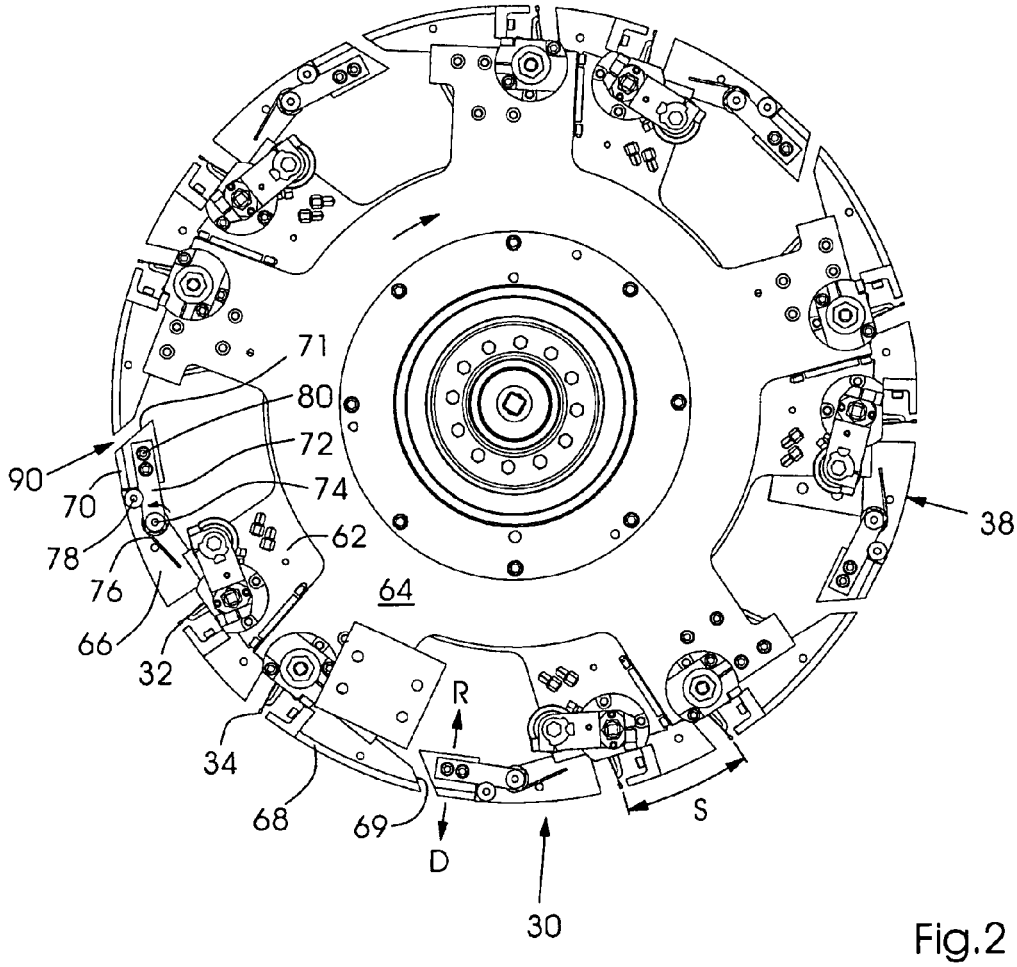
FIG. 2 shows a side view of a jaw cylinder of the folder of FIG. 1 according to the present invention, the jaw cylinder being in a double parallel mode.

As shown in FIG. 2, jaw cylinder 30 has first jaws 32 attached to a first jaw spider 62 and second jaws 34 attached to a second jaw spider 64. First jaw spider 62 has a part 66 at outer circumferential surface 38 of the jaw cylinder 30, and second jaw spider 64 has a part 68 at outer circumferential surface 38.

Figure 3:
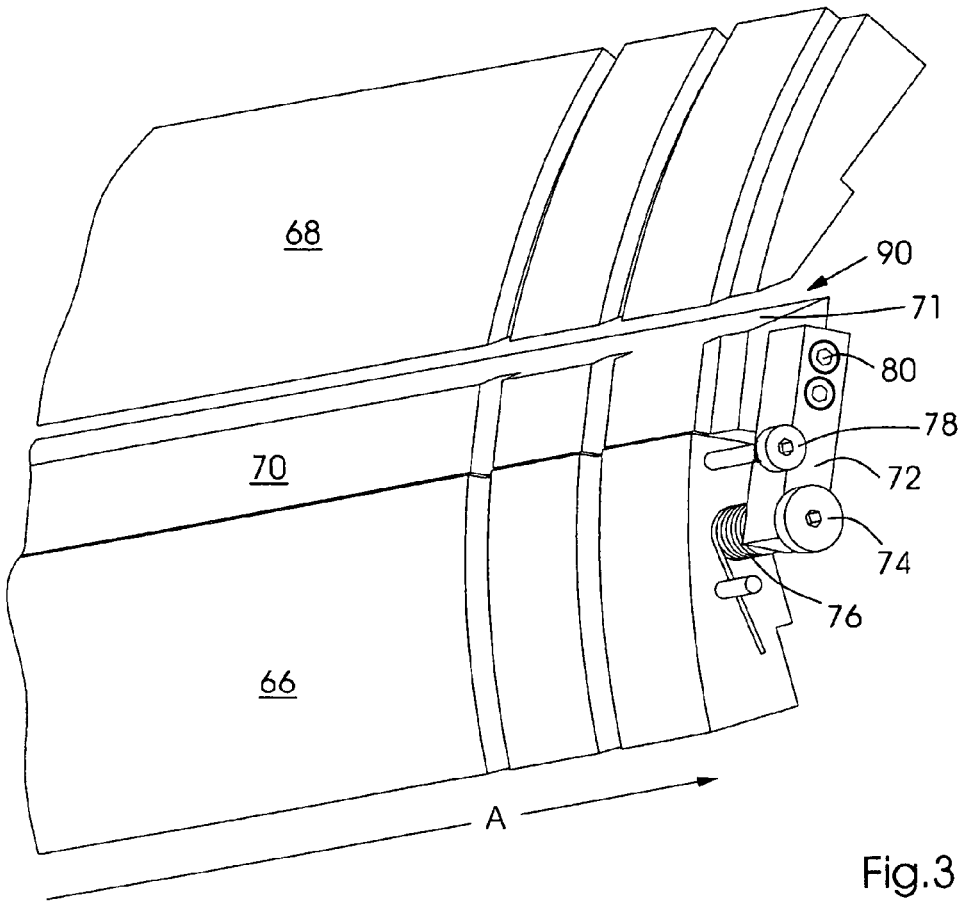
FIG. 3 shows a partial perspective view of FIG. 2.

As shown in both FIG. 2 and FIG. 3, a circumferential surface part 70 is attached in a gap 90 between parts 66 and 68. Circumferential surface part 70 is attached rotatably at both axial ends via a bolt 74 to part 66. A support 72 may be fixed via bolts 80 to circumferential surface part 70, bolt 74 passing through the other end of support 72 and being connected to part 66. A spring 76 may force load the circumferential surface part 70 in a direction D. A stop 78 may aid in preventing motion in direction D, although the interaction of part 66 and 70 may also prevent the movement of circumferential surface part 70 beyond the outer circumferential surface 38. Circumferential surface part 70 is thus freely rotatable in a radially inward direction R when located at the outer circumferential surface.

As shown in FIG. 3, part 70 and parts 66 and 68 may have a same axial extent in axial direction A, and grooves in the parts 66, 68, 70 may be at the same axial locations.

As shown in FIG. 2, circumferential surface part 70 has a radially-extending inclined surface 71 facing outer circumferential surface 38. Surface 71 can interact with a radially-extending inclined surface 69 of part 68, surface 69 facing away from outer circumferential surface 38.

During a mode change, for example to move jaw cylinder 30 to a delta fold mode, the first and second jaw spiders 62, 64 may be varied to increase the spacing S between jaws 32 and 34. Part 68 contacts circumferential surface part 70, and via the interaction of inclined surfaces 71 and 69, part 68 is forced radially inwardly in direction R so that part 68 is forced underneath circumferential surface part 70

Figure 4:
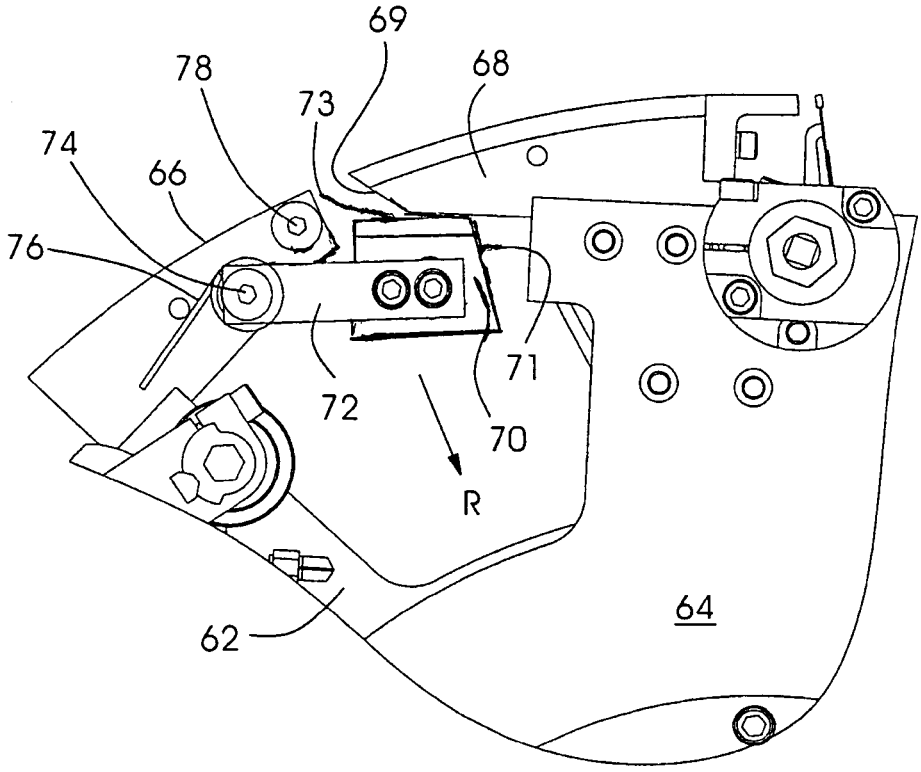
FIG. 4 shows a partial side view of the jaw cylinder of FIG. 2 in a delta mode.

FIG. 4 shows a partial side view of the jaw cylinder of FIG. 2 in a delta mode. Spiders 62, 64 have moved relative to one another from the FIG. 2 configuration, so that a radially-extending inclined surface 69 of part 68 contacts a radially-inclined surface 71 of circumferential part 70. Part 70 as a result rotates about bolt 74 against the action of spring 76 and away from stop 78 in direction R. The outer surface 73 of part 70 comes to rest below part 68.

While the preferred embodiment shows the present invention used with a jaw cylinder, the present invention is applicable to other folder cylinders.

LIST OF ELEMENTS

10 folder
12 former board
13 web
14 cutting device
20 first tucking cylinder
30 jaw cylinder
32 first jaws
34 second jaws
38 outer circumferential surface
40 second tucking cylinder
42 grippers
44 tuckers
62 first jaw spider
64 second jaw spider
66 part
68 part
69 radially-extending inclined surface
70 circumferential surface part
71 radially-extending inclined surface
72 support
73 outer surface
74 bolt
76 spring
78 stop
80 bolts
90 gap

What is claimed is:

1. A folder cylinder with an outer circumferential surface comprising:

a first section having a first part at the outer circumferential surface of the cylinder;

a second section having a second part at the outer circumferential surface of the cylinder, the first section being movable with respect to the second section, the first part being spaced from the second part at the outer circumferential surface in a first operating mode by a gap; and a circumferential surface part attached movably to the second section and defining at the gap part of the outer circumferential surface during the first operating mode, the circumferential surface part being freely rotatable in a radially inward direction with respect to the second section when the circumferential surface part is located at the outer circumferential surface.

2. The cylinder as recited in claim 1 further comprising a stop on the second section for blocking rotation of the circumferential surface part in a direction opposite the radially inward direction.

3. The cylinder as recited in claim 1 further comprising a spring for forcing the circumferential surface part opposite the radially inward direction.

4. The cylinder as recited in claim 1 wherein the first part contacts the circumferential surface part during a second operating mode so as to force the circumferential surface part in the radially inward direction.

5. The cylinder as recited in claim 1 further comprising a first jaw attached to the first section and a second jaw attached to the second section.

6. The cylinder as recited in claim 1 wherein the circumferential surface part has a radially extending inclined surface facing the outer circumferential surface for interacting with the first section so as to retract the circumferential surface part beneath the first part.

7. The cylinder as recited in claim 6 wherein the inclined surface has a same axial extent as the first section.

8. The cylinder as recited in claim 6 wherein the first part has another radially extending inclined surface facing away from the outer circumferential surface.

9. A folder cylinder with an outer circumferential surface comprising:

a first section having a first part at the outer circumferential surface of the cylinder;

a second section having a second part at the outer circumferential surface of the cylinder, the first section being movable with respect to the second section, the first part being spaced from the second part at the outer circumferential surface in a first operating mode by a gap; and a circumferential surface part attached movably to the second section and forming part of the outer circumferential surface at the gap during the first operating mode, the circumferential surface part having a radially extending inclined surface facing the outer circumferential surface for interacting with the first section so as to retract the circumferential surface part beneath the first part.

10. The cylinder as recited in claim 9 wherein the inclined surface has a same axial extent as the first section.

11. The cylinder as recited in claim 9 further comprising a stop on the second section for blocking rotation of the circumferential surface part in a direction opposite the radially inward direction.

12. The cylinder as recited in claim 9 further comprising a spring for forcing the circumferential surface part opposite the radially inward direction.

13. The cylinder as recited in claim 9 wherein the first part has another radially extending inclined surface facing away from the outer circumferential surface.

* * * * *

UNITED STATES PATENT AND TRADEMARK OFFICE

CERTIFICATE OF CORRECTION

PATENT NO. : 7,004,068 B2
APPLICATION NO. : 10/637795
DATED : February 28, 2006
INVENTOR(S) : Jatinder Singh Sappal It is certified that error appears in the above-identified patent and that said Letters Patent is hereby corrected as shown below:

TITLE PAGE, ITEM (56) REF. CITED, US PAT. DOC., INSERT:
5,429,578 to Calbrix et al., U.S. class 493/359, filed 07/1995

Signed and Sealed this

First Day of August, 2006

JON W. DUDAS
*Director of the United States Patent and Trademark Office*